US006345600B1

(12) United States Patent
Schneider

(10) Patent No.: US 6,345,600 B1
(45) Date of Patent: Feb. 12, 2002

(54) ARRANGEMENT OF OIL AND VACUUM PUMPS FOR A DRIVE-MOTOR ASSEMBLY, PARTICULARLY WITH AN INTERNAL COMBUSTION ENGINE

(75) Inventor: Willi Schneider, Ingolstadt (DE)

(73) Assignee: Joma-Hydromechanic GmbH, Bodelshausen (DE)

( * ) Notice: Subject to any disclaimer, the term of this patent is extended or adjusted under 35 U.S.C. 154(b) by 0 days.

(21) Appl. No.: 09/605,746

(22) Filed: Jun. 29, 2000

(30) Foreign Application Priority Data

Jun. 29, 1999 (DE) ..... 199 29 631

(51) Int. Cl.[7] ..... F02B 77/00

(52) U.S. Cl. ..... 123/198 C; 417/423.14; 417/360; 123/196 R

(58) Field of Search ..... 123/198 C, 196 R; 417/423.14, 360

(56) References Cited

U.S. PATENT DOCUMENTS 4,806,075 A * 2/1989 Osterstrom et al. ..... 415/170 R
5,282,446 A * 2/1994 Whitefield ..... 123/198 C

FOREIGN PATENT DOCUMENTS

DE A1-2833167 2/1980

* cited by examiner

*Primary Examiner*—Tony M. Argenbright
*Assistant Examiner*—Katrina B. Harris

(57) ABSTRACT

An arrangement of oil and vacuum pumps on a driving motor, particularly an internal combustion engine, with which technical and installation expenditures are greatly reduced, involves combining the oil pump and vacuum pump as a modular unit, with pump rotors thereof being driven from a common pump shaft.

10 Claims, 1 Drawing Sheet

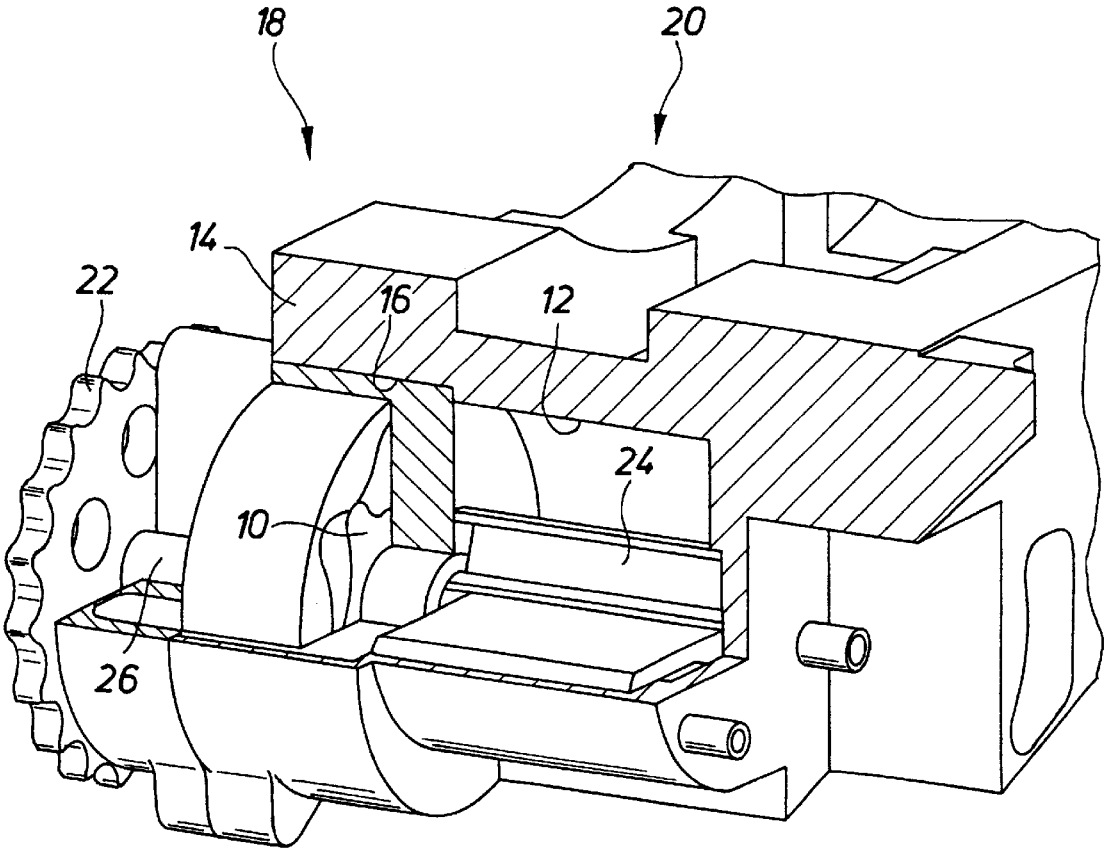
18
20
14
22
16
12
24
10
26

ARRANGEMENT OF OIL AND VACUUM PUMPS FOR A DRIVE-MOTOR ASSEMBLY, PARTICULARLY WITH AN INTERNAL COMBUSTION ENGINE

This application claims a priority based on German Patent Application 199 29 631.6, filed Jun. 29, 1999, and all material in that German Priority Application is incorporated by reference herein.

BACKGROUND OF THE INVENTION

This invention relates to an arrangement of oil and vacuum pumps which form components of a drive-motor assembly, particularly with internal combustion engines, which are driven from a motor thereof.

In an internal-combustion-engine assembly of a motor vehicle, an oil pump, for pressure-circulating lubrication, and a vacuum pump, as a partial-vacuum source for a brake booster, are respectively installed at separate locations on an engine, or motor, with the oil pump being customarily driven by a crankshaft and the vacuum pump by a camshaft.

The two pumps thereby form individually-produced and separately-installed units.

It is an object of this invention to reduce both technical and installation expenditures for these pumps.

SUMMARY OF THE INVENTION

According to principles of the invention, oil and vacuum pumps that are for forming components of a drive-engine assembly, to be driven by a drive engine thereof, are combined as a modular unit, with pump rotors thereof being driven via a common pump shaft.

BRIEF DESCRIPTION OF THE DRAWING

Further advantages, features and details of the invention are set forth in the following description, in which a particularly preferred embodiment is described with reference to the drawing. In this regard, the features set forth in the drawing and in the specification, including the claims, can respectively be inventive individually or in desired combinations.

The drawing is an isometric view of a drive-motor assembly having a pump arrangement of this invention thereon.

DESCRIPTION OF THE PREFERRED EMBODIMENT

Combining oil and vacuum pumps as a single modular unit and driving pump rotors 10 and 24 thereof via a common pump shaft 26 makes possible a considerable structural simplification of the pumps, in that each pump does not need its own pump housing and can, with its pump rotor, be provided in a common receiver housing 12 serving as a stator, which is formed either by a motor block 14 or motor subhousing, or parts thereof. It necessarily follows that a considerable reduction in weight with a simplification in installation is made possible, with the pumps only needing to be placed in a receiver cavity 16 in the motor block 14 or in a motor housing.

Further, through the combination of the two pumps 18 and 20, a hydraulic-mechanical efficiency ratio can be increased.

By selecting special materials for the two pumps, the hydraulic-mechanical efficiency can be further improved, whereby, in particular, a considerable reduction of rotating mass is made possible. The rotor 10, 24 of each of the two pumps can be made of plastic, ceramic, a plastic-metal combination, or a material combination of plastic, ceramic, and metal.

Similarly, such materials or material combinations can also be advantageously used for the pump housing, or for the motor block or the motor subhousing.

The drive linkage of the duo-pump, formed of the oil pump 18 and vacuum pump 20, can be driven, via the pump shaft, advantageously directly from the crankshaft, or from a driving belt or a driving chain and driving sprocket 22 driven by the crankshaft that drives additional units of the driving motor at the same time.

Such a drive take-off from the motor offers the significant advantage that the vacuum pump 20 can be designed for significantly lower output in comparison to camshaft-driven vacuum pump 20, while still achieving a pump output per unit of time that corresponds to an output of a larger camshaft-driven vacuum pump.

This is made possible in that the belt or chain drive, in comparison to a camshaft drive, allows the pump shaft to be operated at a correspondingly higher rotational speed.

The invention claimed is:

1. An arrangement of oil and vacuum pumps (18, 20) for forming components of a drive motor assembly, the oil and vacuum pumps (18, 20) for being driven by a drive motor of the motor assembly, said drive motor including a motor block and a motor subhousing, wherein the oil pump and the vacuum pump are combined into a modular unit with their pump rotors (10 and 24) being driven from a common pump shaft (26), the two pumps having a common pump housing at least partially formed of at least one of the motor block and the motor subhousing with said pump rotors of the oil and vacuum pump being installed in a cavity at least partially formed of said one of the motor block and the motor subhousing.

2. The arrangement as in claim 1, wherein the rotor of each of the two pumps is made of plastic.

3. The arrangement as in claim 1, wherein the rotor of each of the two pumps is made of ceramic.

4. The arrangement as in claim 1, wherein the rotor of each of the two pumps is made of a plastic-metal combination.

5. The arrangement as in claim 1, wherein the rotor of each of the two pumps is made of a material combination of plastic, ceramic, and metal.

6. The arrangement as in claim 1, wherein the at least one of the motor block and motor subhousing at least partially forming said pump housing is made of plastic.

7. The arrangement as in claim 1, wherein the at least one of the motor block and motor subhousing at least partially forming said pump housing is made of ceramic.

8. The arrangement as in claim 1, wherein the at least one of the motor block and motor subhousing at least partially forming said pump housing is made of a plastic-metal combination.

9. The arrangement as in claim 1, wherein the at least one of the motor block and motor subhousing at least partially forming said pump housing is made of a material combination of plastic, ceramic, and metal.

10. The arrangement as in claim 1 wherein the common pump housing is formed of said motor block, with said pump rotors installed in a cavity of said motor block.

* * * * *